US006900582B2

(12) United States Patent
Fornari et al.

(10) Patent No.: US 6,900,582 B2
(45) Date of Patent: May 31, 2005

(54) CRT HAVING A TENSION MASK WITH VIBRATION DAMPING MEAN

(75) Inventors: Fabrizio Fornari, Palestrna (IT); Stefano Necci, Anagni (IT); Fabrizio Berton, Segni (IT); Silvio Santovincenzo, Anagni (IT); Mario Battisti, Carpineto (IT)

(73) Assignee: Thomson Licensing S. A., Boulogne-Billancourt (FR)

( * ) Notice: Subject to any disclaimer, the term of this patent is extended or adjusted under 35 U.S.C. 154(b) by 0 days.

(21) Appl. No.: 10/415,574

(22) PCT Filed: Oct. 23, 2001

(86) PCT No.: PCT/EP01/12210

§ 371 (c)(1),
(2), (4) Date: May 2, 2003

(87) PCT Pub. No.: WO02/39477

PCT Pub. Date: May 16, 2002

(65) Prior Publication Data

US 2004/0021409 A1 Feb. 5, 2004

(30) Foreign Application Priority Data

Nov. 7, 2000 (IT) ..... MI2000A2397

(51) Int. Cl.[7] ..... H01J 29/80
(52) U.S. Cl. ..... 313/402; 313/407

(58) Field of Search ..... 313/402, 404, 313/407, 408

(56) References Cited

U.S. PATENT DOCUMENTS

| | | | | | |
|---|---|---|---|---|---|
| 4,827,179 | A | | 5/1989 | Adler et al. | 313/402 |
| 6,469,429 | B1 | * | 10/2002 | Berton | 313/402 |
| 6,520,475 | B2 | * | 2/2003 | Haun et al. | 248/636 |
| 6,590,328 | B2 | * | 7/2003 | Shin et al. | 313/407 |
| 6,614,152 | B1 | * | 9/2003 | Berton et al. | 313/402 |
| 2001/0002352 | A1 | | 5/2001 | Mizuta et al. | 445/35 |

FOREIGN PATENT DOCUMENTS

| | | | |
|---|---|---|---|
| EP | 1098349 | 5/2001 | H01J/29/07 |
| EP | 02/09138 | 1/2002 | H01J/29/07 |

* cited by examiner

*Primary Examiner*—Joseph Williams
*Assistant Examiner*—Kevin Quarterman
(74) *Attorney, Agent, or Firm*—Joseph S. Tripoli; Harvey D. Fried; Patricia A. Verlangieri

(57) ABSTRACT

Color cathode-ray tube comprising a color selection mask tensioned in at least one direction, the mask having, on its peripheral area, mask-vibration damper means in the form of a coupled oscillator of the type comprising a metal strip whose ends are welded to the surface of the mask and whose central region comes into contact with the surface of the mask by a spring effect.

11 Claims, 4 Drawing Sheets

CRT HAVING A TENSION MASK WITH VIBRATION DAMPING MEAN

This application claims the benefit, under 35 U.S.C. § 365 of International Application PCT/EP01/12210, filed Oct. 23, 2001, which was published in accordance with PCT Article 21(2) on May 16, 2002 in English and which claims the benefit of Italian patent application No. MI2000A002397, filed Nov. 7, 2000.

The present invention generally relates to cathode-ray tubes and, more particularly, to the structures of color selection masks' capable of damping vibrations in masks.

Conventional cathode-ray tubes have a color selection mask located at a precise distance from the inside of the glass faceplate of the tube, on which faceplate arrays of red, green and blue phosphors are deposited in order to form a screen. An electron gun placed inside the tube, in its rear part, generates three electron beams directed towards the faceplate. An electromagnetic deflection device, generally placed on the outside of the tube and close to the electron gun has the function of deflecting the electron beams so that they scan the surface of the faceplate on which the arrays of phosphors are arranged. Under the influence of the three electron beams, each corresponding to a defined primary color, the arrays of phosphors reproduce images on the screen, the mask allowing each defined beam to illuminate only the phosphor of the color corresponding to it.

The color selection mask must be placed and held throughout the operation of the tube in a precise position inside the tube. The functions of holding the mask are carried out by means of a generally very rigid rectangular metal frame to which the mask is conventionally welded. The frame/mask assembly is mounted in the faceplate of the tube by suspension means usually welded to the frame and engaging with pins inserted into the glass forming the faceplate of the tube.

Tubes whose faceplate is becoming flatter and flatter are following the current trend of moving towards faceplates which are completely flat. To produce tubes with such a faceplate involves a technology that uses a flat mask held under tension along at least one direction. Such structures are described, for example, in U.S. Pat. No. 4,827,179.

Since the color selection mask consists of a very thin metal foil, tensioning it may result in undesirable phenomena due to the vibration of the said mask during, operation of the tube. Under the influence of external mechanical shock or vibrations, for example acoustic vibrations due to the loudspeakers of the television set into which the tube is inserted, the mask may vibrate at its natural resonant frequency. The vibrations of the mask consequently modify the area of impingement of the electron beams on the screen of the tube, the points of impact of each beam then being offset with respect to the associated array of phosphors, thus discoloring the image reproduced on the screen.

U.S. Pat. No. 4,827,1,79 proposes adding mask-vibration damping means to one side of the mask. However, the damping devices employed in that patent have a complicated structure difficult to realize. Hence, a need exists to develop damping means that are less complicated and less expensive.

The present invention provide a cathode-ray tube (CRT) comprising a mask structure with simple and less expensive damping means. More specifically, the CRT according to the invention comprises a color selection mask in the form of an approximately rectangular metal foil, suitable for being fixed in tension to a support frame and mounted on the inside of the faceplate of the tube, the said mask including a central area containing apertures and a peripheral area lying between the central area and the edges of the mask, the said mask being capable of vibrating independently of the support frame. Mask-vibration damping means placed around the said periphery of the mask. The damping means include at least one coupled oscillator in the form of a flexible metal strip, part of which is fastened to one surface of the peripheral area of the mask in at least two separate points, thereby facilitating a means to damp the vibrations with a simple mechanical fixture.

The invention will be more clearly understood from the description below and from the drawings in which:

FIG. 1 shows a cathode-ray tube according to the invention, seen in partially exploded view;

FIG. 2 describes a tensioned mask/frame assembly according to the prior art without a vibration damper;

Figure 1:
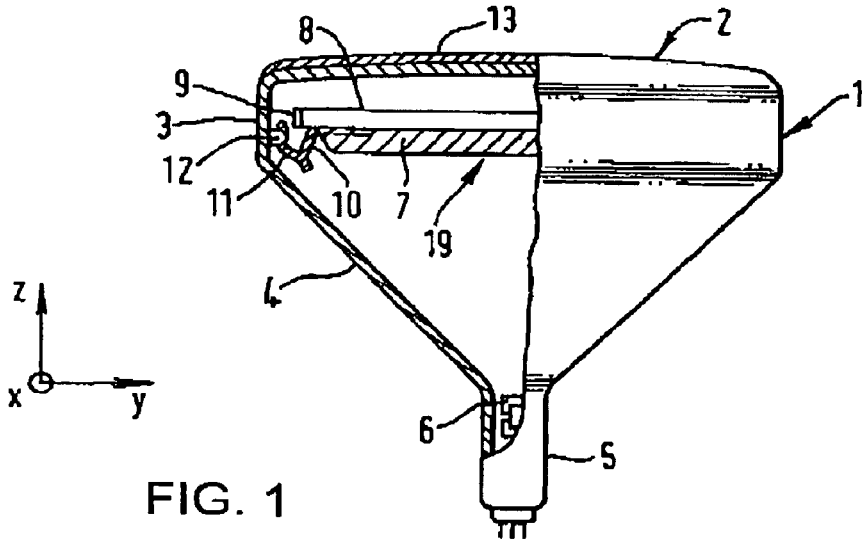

As illustrated in FIG. 1, a cathode-ray tube (CRT) 1 according to the invention comprises an approximately flat faceplate 2 and a peripheral skirt 3. The faceplate 2 is joined to the funnel-shaped part 4 of the tube 1 by a glass frit seal. The end part 5 of the tube surrounds the electron gun 6, the beams from which illuminate the luminescent phosphor screen 13 through the color selection mask 8, which in this case is flat, for example tensioned between the long sides 9 of the frame 19. Metal supports of the mask/frame assembly hold this assembly in place inside the tube, the said supports possibly having a part 10 welded to the frame 19 and a spring-forming part 11 provided with an opening with which a pin 12 included in the glass skirt 3 engages.

Figure 2:
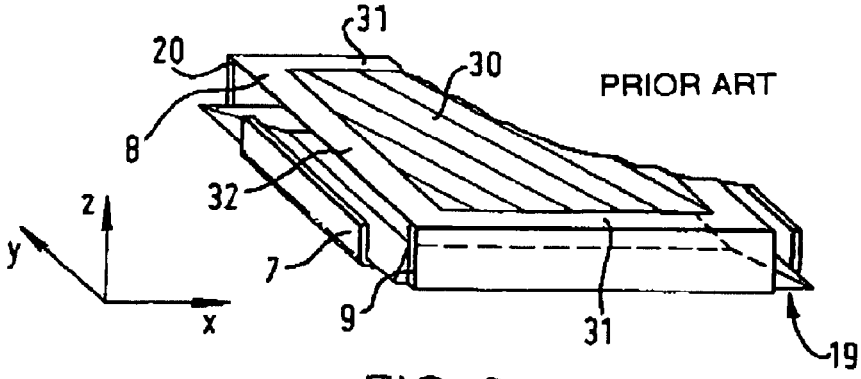

In the example of the prior art illustrated in FIG. 2, the frame 19 comprises a pair of long sides 9 and a pair of short sides 7, the said long and short sides having, for example, a L-shaped cross section. The mask 8 itself, of approximately rectangular shape, is tensioned and then held in this state, for example by welding it to the end 20 of the long sides 9 of the frame 19.

The mask 8 consists of a metal foil, for example made of steel or of Invar, which can have a thickness of about 100 $\mu$m. The mask 8 has a central area 30 having apertures generally arranged in columns and a peripheral area 28 surrounding the central area by horizontal edges 31 and vertical edges 32.

CRT 1 structures using tensioned color selection masks 8 have to confront the problem of mask vibratations, in its eigenmodes, when the said mask 8 is excited by external vibrations, for example by mechanical shocks to the tube 1 or sound vibrations emanating from the loudspeakers placed near the tube 1. Since these vibrations result in the mask 8 moving in a direction perpendicular to its surface, the distance between the apertures in the mask 8 and the screen 13 varies locally according the amplitude of the vibration of the said mask 8. The purity of the colors reproduced on the screen 13 is therefore no longer guaranteed, the point of impingement of the beams on the screen 13 being shifted according to the vibration amplitude.

Moreover, since the mask 8 is placed inside the tube 1 in which there is a high vacuum, the vibrations of the mask 8 are damped only very slowly, the energy transferred to the mask 8 having few means of dissipation, thereby increasing the visibility of the shifting phenomenon on the screen 8 when the tube 1 is in operation.

Figure 3:
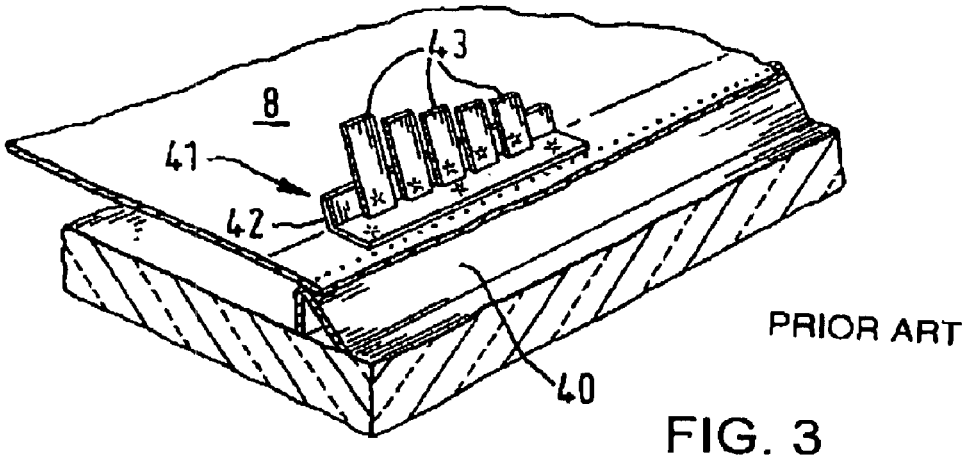
FIG. 3 is a perspective view of one embodiment of a vibration-damping device according to the prior art.

As illustrated in FIG. 3, U.S. Pat. No. 4,827,179 provides a solution for damping the vibrations of the mask 8 by a prior art damping device 41 forming a coupled oscillator, being placed on the edges of the mask 8, near the area where the mask 8 is welded to the prior art frame 40, and a mechanical structure comprising a rigid support 42 to which at least one flexible strip 43 is welded. The natural resonant frequency of the prior art damping device 41 is chosen so as to damp the mask vibrations in a defined frequency band. However, this structure has the following drawbacks:

it, is complex and expensive because of the large number of metal parts used (rigid support 42 and flexible strips 43) and energy-dissipating elements must be added to the damping structure if the aim is to provide rapid damping of the mask vibrations.

The present invention provides a simple, inexpensive and easily realizable structure for damping the vibrations of a mask 8 tensioned in one or two directions.

Figure 5:
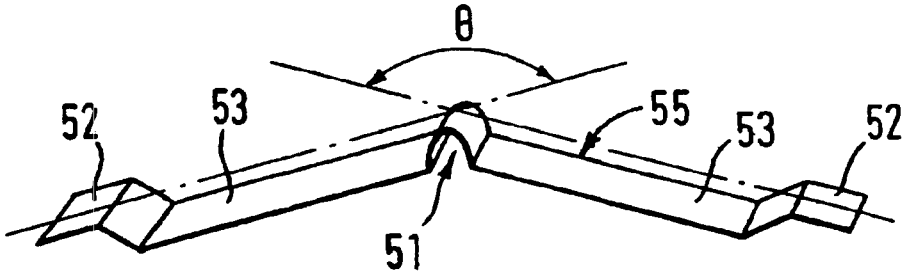
FIG. 5 shows an embodiment of a vibration damper according to the invention.
Figure 6:
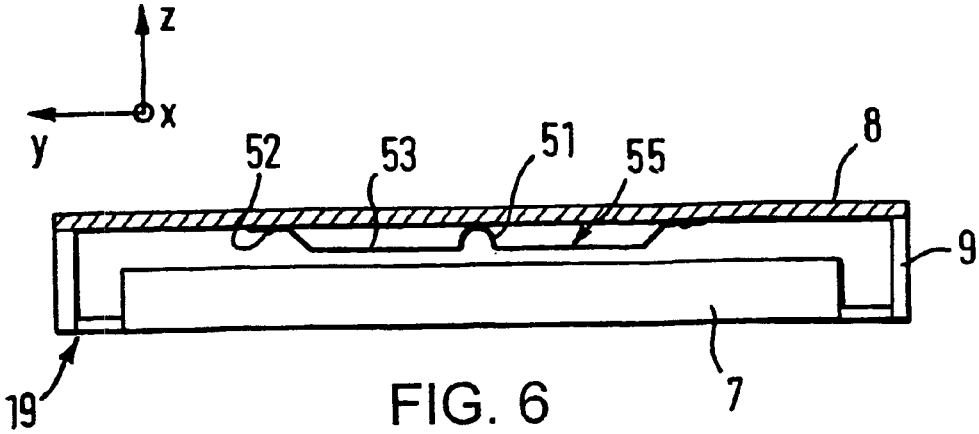
FIG. 6 shows, in side view, the vibration damper according to the invention, held in place on the mask/frame structure.

FIG. 5 is a view in isometric perspective of a first embodiment of the invention, which can be fitted to a mask 8 tensioned in one direction, for example parallel, to its short sides 7, and FIG. 6 illustrates an example of how this damper is fitted along the edges of the mask 8.

Placed in the peripheral area 28 of the mask 8, for example-along short vertical edge 32, is a damping device 55 in the form of a metal band fastened to the surface of the mask, for example by welding it at two points 52 close to its ends. The damping device 55 may thus be made as a single piece by cutting and folding a metal strip so as to produce two parts 53 away from the plane of contact with the masks 8. The two parts 53 are separated by a substantially U-shaped central region 51 intended to come into contact with the surface of the mask 8. At rest, before it is fixed to the mask 8, the damping device 55 is bent in such a way that the two parts 53 make an angle θ of less than 180°; in this way, when welding the ends 52 to the edge of the mask, the U-shaped central region 51 bears against the surface of the said mask 8 by a spring effect. The damping device 55 forms, with the mask 8, a system of coupled oscillators; the parameters of the damping device 55, such as, for example, the length of the parts 53, their thickness and their weight are chosen conventionally so that the natural vibration frequency of the said parts 53 is close to a chosen value. For example, the natural resonant frequency of the mask 8, which is generally equal to a few tens of hertz, often between 50 Hz and 150 Hz. The points 52, which are spot welded, act as vibration nodes; the contact point of the U-shaped central region 51, rubs against the surface of the mask 8 when it vibrates, improving the dissipation of vibration energy stored in the mask 8. Because the bridges formed by the parts 53 lying between the points 52 and the U-shaped central region 51 have a natural vibration frequency substantially the same as that of the mask 8, there is maximum energy transfer between these bridges and the mask 8, thereby attenuating the vibration amplitude of the said mask 8.

Figure 4:
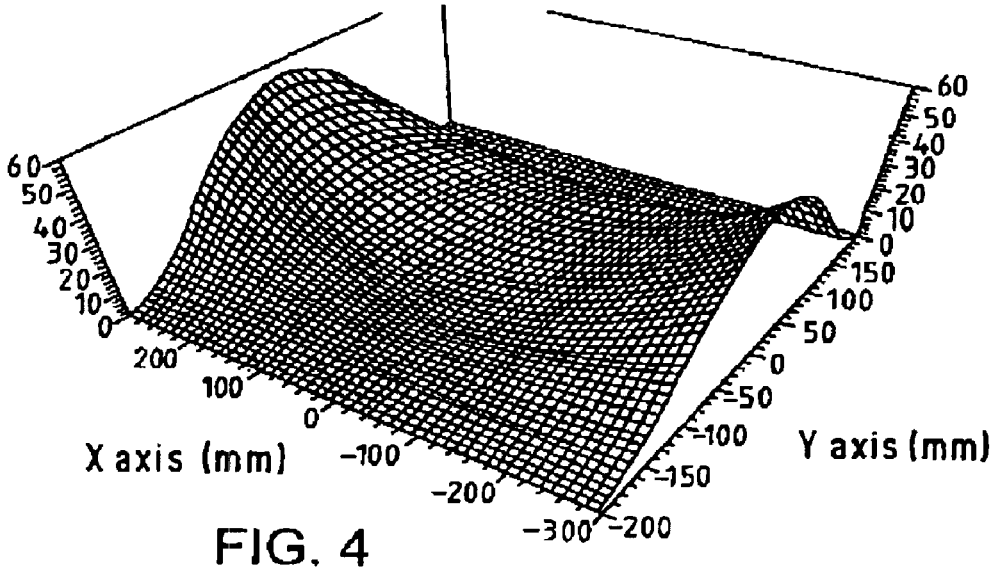
FIG. 4 illustrates the displacement profile of the surface of a tensioned mask subjected to vibrations.

When the mask/frame device is such that the mask 8 has a central area 30 with apertures in columns joined together by metal bridges and when the tension exerted on the mask 8 is uniaxial, for example along the direction of the short sides 7, the horizontal edge 31 being welded to the long sides 9 of the frame, the behavior of the mask 8 in vibration is according to FIG. 4; the amplitude of vibration of the mask is a maximum in the middle of the vertical edge 32. For a tube 1 incorporating a mask/frame device of the type described above, it is therefore advantageous to place a damping device according to the invention along each of the short sides 7 of the mask 8, the U-shaped central region 51 being positioned in the middle of the horizontal edge 32.

In a simplified embodiment, not shown, the damper device 55 according to the invention has the shape of a bridge, cut from a metal strip and welded to the vertical edges 32 of the mask 8. Several two bridge damper devices 55 may be placed along the vertical edg s 32 of the short sides 7 of the mask 8 symmetrically with respect to the horizontal axis X of symmetry of the mask 8.

The invention provides a structure allowing the simple use of supplementary means of dissipating the energy transferred to the mask 8 during a shock to the tube 1 or via powerful soundwaves. However, it is necessary to prevent the vibrations transferred to the mask 8, even if they are of small amplitude, from lasting too long since they then become visible during the operation of the tube 1.

Figure 7:
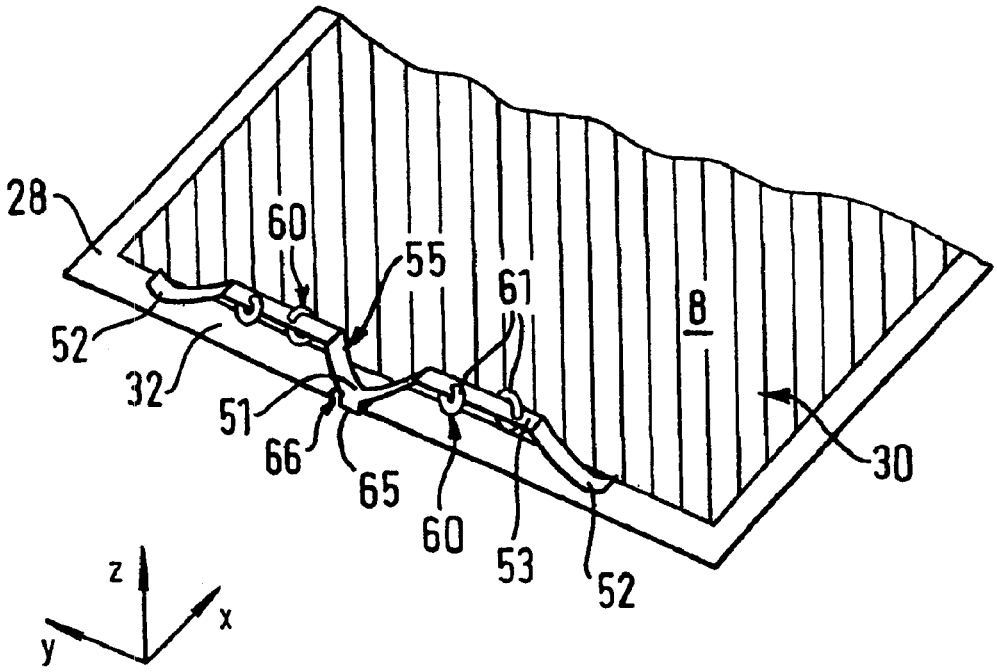
FIG. 7 illustrates a second embodiment of the invention.

To reduce the oscillation time of the mask 8, it is possible, as illustrated by the perspective view in FIG. 7, to add to the damping device 55 at least one metal clip 60 passing through an orifice 61 made in bridge part 53. The clip 60 may be open or closed, its cross section being slightly less than the diameter of the orifice 61 so as to be able to move in this orifice 61 and dissipate the energy transferred by the mask 8 by rotating in the orifice 61 and/or by friction against the edge of the said orifice.

In another embodiment not shown, rivets are placed so as to cross the bridge parts 53 through orifices 61 made through the said bridge parts 53, the heads of the rivets having a size greater than that of the orifices 61 while the body of the rivet has a smaller cross section than the diameter of the said orifice 61.

The arrangement of the damping devices 55, coupled oscillators, along the short sides 7 of the mask 8 is not limiting. For example, if the mask 8 is tensioned along two directions parallel to its length and to its width, it is advantageous to place the vibration dampers according to the invention both along the horizontal edges 31 and vertical edges 32 of the said mask 8.

Moreover, it does not matter whether the oscillators, damping devices 55, according to the invention are placed on that surface of the mask which faces the phosphor screen 13 (i.e., screen-facing side) or, conversely, on that surface of the mask 8 on the side facing the electron gun 6 (i.e., gun-facing side). It may also be advantageous to place these damping devices 55 on both faces of the mask 8 so as to obtain the desired damping effect.

Means for positioning the coupled oscillator, damping device 55, on the surface of the mask 8 may be added without complex modification to the structure of the said damping device 55 or of the mask 8 itself. The purpose of these means is to facilitate the positioning of the coupled oscillator, damping device 55, along the edge of the mask 8 during the process of manufacturing the tube 1. As illustrated in FIG. 7, these positioning means may consist of a tab 65 integral with the oscillator, damping device 55, and engaging in a notch 66 located on the edge of the mask 8.

Alternatively, the tab 65 may be integral with the mask 8 and the notch 66 located on the U-shaped central part 51 of the oscillator damping device 55.

In another embodiment not illustrated, the positioning means may consist of a boss intended to be inserted into a suitable opening. The boss may be placed on the mask 8, in which case it then engages in an opening made in that part of the damping device 55 which comes into contact with the mask 8. Alternatively, the boss may be placed on the surface of the damping device 55, for example, on its U-shaped central part 51 or its end points 52, and in which case it then engages in an opening made in the edge of the mask 8.

What is claimed is:

1. A color cathode-ray tube comprising:

a color selection mask in the form of an approximately rectangular metal foil, suitable for being fixed in tension to a support frame and mounted on the inside of the faceplate of the tube, the said mask having a central area having apertures and a peripheral area lying between the central area and edges of the mask, the said mask being capable of vibrating independently of the support frame; and mask-vibration damping means placed on the said peripheral area of the mask in order to damp the vibrations in the said mask, wherein the damping means comprise at least one coupled oscillator in the form of a flexible metal strip comprising a central portion which comes into contact with the mask, the flexible metal strip being fastened to a surface of the peripheral area of the mask at at least two separate points placed on both sides of the central portion.

2. The cathode-ray tube as claimed in claim 1, wherein the central region of the flexible metal strip comes into contact with the surface of the mask by a spring effect.

3. The cathode-ray tube as claimed in claim 1, wherein the natural vibration frequency of that central region of the coupled oscillator which lies between two successive points of contact with the mask being substantially the same as the frequency of the mask to be attenuated.

4. The cathode-ray tube as claimed in claim 1, wherein the mask being tensioned along a single direction and the coupled oscillator being fixed to one edge of the mask so as to lie in a direction parallel to the direction in which the mask is tensioned.

5. The cathode-ray tube as claimed in claim 1, wherein the coupled oscillator furthermore including an additional means for dissipating the vibration energy.

6. The cathode-ray tube as claimed in claim 5, wherein the additional means for dissipating the energy having at least one ring passing through the thickness of the metal strip forming the coupled oscillator.

7. The cathode-ray tube as claimed in claim 1, wherein a coupled oscillator and the mask including additional interacting positioning means for positioning the said coupled oscillator to a surface of the mask.

8. The cathode-ray tube as claimed in claim 7, wherein by the positioning means having a boss which engages in an opening.

9. The cathode-ray tube as claimed in claim 7, wherein by the positioning means having a tab which engages in a notch.

10. The cathode-ray tube as claimed in claim 1, wherein at least one of the damping means being on a screen-facing side of said mask.

11. The cathode-ray tube as claimed in claim 1, wherein by at least one of the damping means being attached on a gun-facing side of said mask.

* * * * *